United States Patent [19]

Cook et al.

[11] 3,937,196

[45] Feb. 10, 1976

[54] INTAKE MANIFOLD FOR AN INTERNAL COMBUSTION ENGINE HAVING AN INTERNALLY CONTAINED EXHAUST GAS RECIRCULATION COOLER

[75] Inventors: Robert R. Cook, Dearborn; Roy E. Diehl, Northville, both of Mich.

[73] Assignee: Ford Motor Company, Dearborn, Mich.

[22] Filed: Feb. 5, 1975

[21] Appl. No.: 547,423

[52] U.S. Cl. ..... 123/119 A

[51] Int. Cl.[2] ..... F02B 27/00

[58] Field of Search ..... 123/119 A, 122 AC

[56] References Cited

UNITED STATES PATENTS

| | | | |
|---|---|---|---|
| 3,827,412 | 8/1974 | Waitzman | 123/119 A |
| 3,861,142 | 1/1975 | Bose | 123/119 A |
| 3,868,934 | 3/1975 | Mick | 123/119 A |

*Primary Examiner*—Charles J. Myhre
*Assistant Examiner*—R. H. Lazarus
*Attorney, Agent, or Firm*—Roger E. Erickson; Keith L. Zerschling

[57] ABSTRACT

An intake manifold for an internal combustion engine having an integral exhaust gas recirculation system and an internally contained cooler for recirculated gases. The cooler comprises a heat exchanger which transfers heat from the recirculated exhaust gases to the engine coolant. The heat exchanger is frictionally and resiliently retained within a passage or chamber formed in the manifold casting.

16 Claims, 4 Drawing Figures

12
13
14
16
18
21
23
25
31
32
33
34
35
36
37
38
39
41
42
43
44
45
46
47
48
49
51
52
53
54
4

INTAKE MANIFOLD FOR AN INTERNAL COMBUSTION ENGINE HAVING AN INTERNALLY CONTAINED EXHAUST GAS RECIRCULATION COOLER

BACKGROUND AND SUMMARY OF THE INVENTION

The reintroduction of small amounts of exhaust gases into the combustion cycle of an internal combustion engine to reduce the generation of nitrous oxides is known. It is also known that if the recirculated exhaust gases are cooled, further reductions in generation of nitrous oxides is experienced and fuel of lower octane can be used. In addition, if the recirculated exhaust gases are cooled the valve controlling the flow of exhaust gases has greater durability. It is, therefore, an object of this invention to cool the recirculated exhaust gases to achieve the advantages recited above. It is also an object of this invention to moderate the temperature of the recirculated exhaust gases to permit more accurate metering of the recirculated gases because of their more nearly uniform densities. It is the further object of this invention to provide an intake manifold having a heat exchanger contained in normally wasted space of a V-type internal combustion engine. It is an additional object of this invention to greatly reduce the number of connections from known recirculated exhaust gas cooling systems, and consequently, to reduce the number of potential leaks in the system. Finally, it is an object of this invention to provide an integral intake manifold and exhaust gas recirculation system which is economical to manufacture and which is generally more durable and reliable than prior art apparatus.

The invention comprises an intake manifold for supplying fuel, air and exhaust gases to a V-type multicylinder internal combustion engine having combustion chambers disposed along opposite sides of the longitudinal centerline. The manifold comprises a casting having one or more generally vertical riser passages and one or more generally horizontal plenum chambers in communication with the riser bores. A plurality of runner passages extends generally transversely from the plenum chambers. An exhaust gas crossover passage extends transversely under the plenum chambers and beneath the riser passages. An exhaust gas recirculation passage extends longitudinally from the exhaust gas crossover passage to a means for receiving a gas recirculation control valve constructed to meter the flow of the exhaust gas through the exhaust gas recirculation passage. A metered exhaust gas passage extends from the valve receiving means back to the riser passages. A heat exchanger is positioned in the exhaust gas recirculation passage and includes a longitudinally extending liquid conduit having finned elements extending radially outwardly therefrom. An engine coolant passage is formed within the manifold. The heater exchanger conduit forms a portion of the coolant passage. Seal means separate the conduit from the exhaust gas recirculation passage to define an independent coolant passage and an independent exhaust gas recirculation passage in heat exchange relationship.

DETAILED DESCRIPTION OF THE PREFERRED EMBODIMENT

Figures 1, 4, 5:
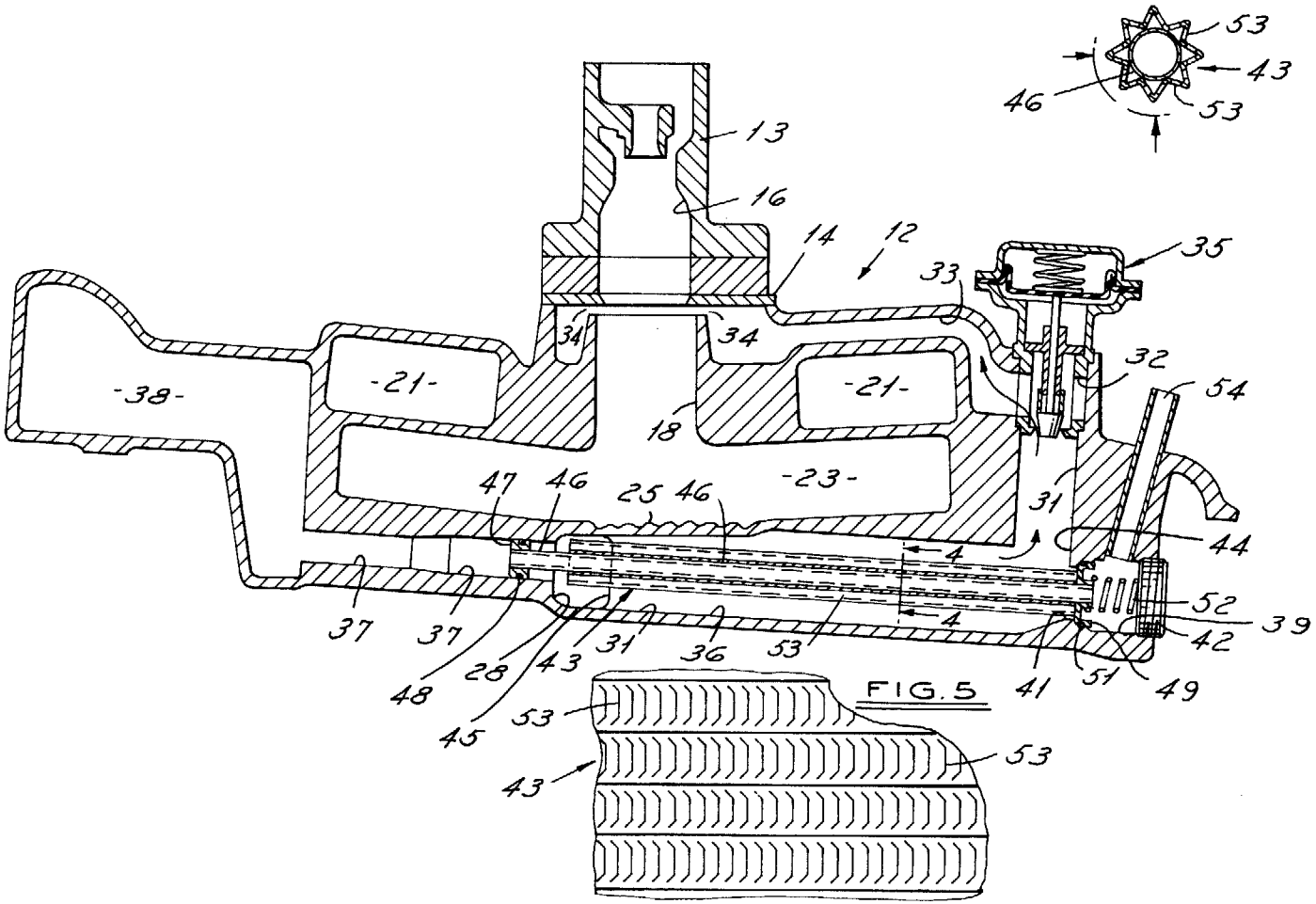
FIG. 1 of the drawings is a longitudinal cross-sectional view of an intake manifold constructed in accordance with this invention.
FIG. 4 is a cross-sectional view of the heat exchanger taken along line 4—4 of FIG. 1.
FIG. 5 is an enlarged side elevational view of the heat exchanger assembly 43, as shown in FIG. 1.
Figure 2:
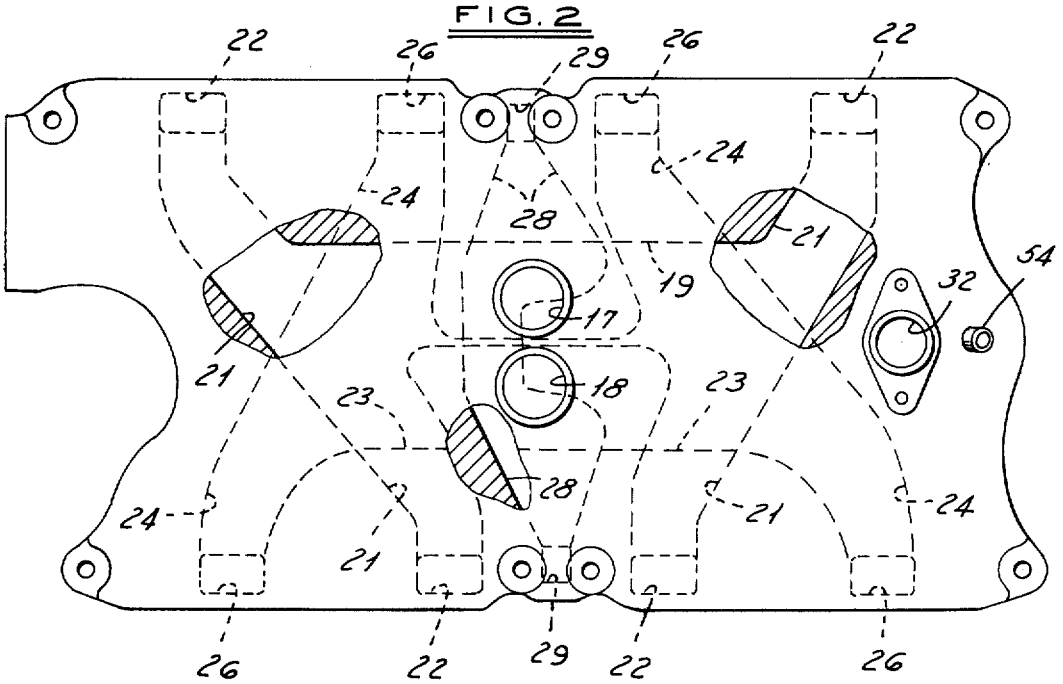
FIG. 2 of the drawings is a top view of the intake manifold showing, among other things, the runner passages and the exhaust crossover passage.
Figure 3:
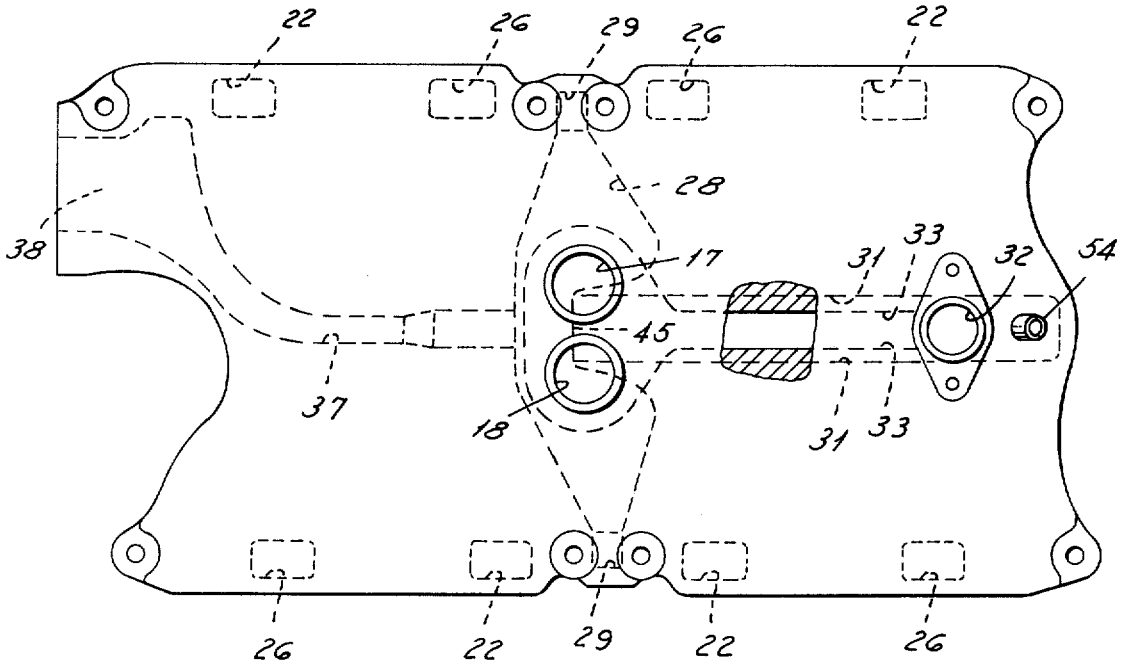
FIG. 3 of the drawings is a top view of the intake manifold showing, among other things, the engine coolant passage, the exhaust gas recirculation passage and the metered gas recirculation passage.

Reference numeral 12 refers generally to an intake manifold for a V-8 internal combustion engine. A carburetor 13 is positioned upon a mounting pad 14 of the manifold. The carburetor has two barrels 16 (only one being shown) which feed a fuel and air mixture into first and second riser bores 17 and 18, respectively, formed in the manifold casting. Riser bore 17 extends vertically and feeds into an upper plenum chamber 19. The plenum chamber extends longitudinally and discharges at each end into generally transversely extending runner passages 21 which deliver a fuel and air mixture to the combustion chamber ports 22.

The second riser bore 18 extends vertically downwardly to a lower plenum chamber 23. The lower plenum chamber extends longitudinally and discharges at each end into generally transversely extending runner passages 24 which deliver a fuel and air mixture of the ports 26. A exhaust crossover passage 28 connects a pair of ports 29 which receive exhaust gases from passages in the engine block. The exhaust crossover passage extends generally transversely and is situated beneath the upper and lower plenum chambers 19 and 23, respectively, and directly below risers 17 and 18 so that exhaust heat is transferred through the floors 25 of the plenum chambers to the fuel and air mixture descending the riser passages.

An exhaust recirculation passage 31 extends from the exhaust crossover passage 28 and terminates at an exhaust recirculation gas control valve receiving means 32. A metered exhaust gas passage 33 extends from the valve receiving means 32 over the plenum chambers toward the riser bores 17 and 18. Metered exhaust gases are reintroduced into the combustion cycle through circumferential openings 34 to the riser bores 17 and 18. An exhaust gas recirculation control valve assembly 35 is received within the receiving means 32 and meters the flow of exhaust gas from the exhaust gas recirculation passage 31 to the metered exhaust gas passage 33.

A longitudinally extending chamber 36 is integrally formed in the manifold casting and is located approximately centrally beneath the plenum chambers and the runner passages. The chamber 36 forms a portion of the exhaust recirculation passage 31. At one end of the chamber 36 is a bore 37 which is a part of an engine coolant passage 38 extending through the manifold. At the other end of the chamber 36 is located a second bore 39 separated from the chamber by an abutment 41. A cap or plug 42 threadedly engages and closes the end of the bore. Removal of the threaded cap provides access to the passage for the introduction of a heat exchanger assembly 43. Between bores 37 and 39 are located an opening 45 from exhaust gas crossover passage 28 and an outlet 44. The outlet 44 is longitudinally spaced a maximum distance from opening 45 to provide maximum exposure of the heat exchanger to the recirculated exhaust gases.

The heat exchanger assembly 43 includes a stainless steel tube or conduit 46 generally cylindrical in shape which extends longitudinally the length of chamber 36 and protrudes axially into bores 37 and 39. An annular 47 is secured to the upstream end of the conduit and includes a circumferential groove in which a silicone O-ring 48 is positioned. The O-ring sealingly engages the bore 37 and permits axial displacement of the member 47 relative to the bore if such displacement is required as the result of differing expansion rates. A second annular member 49 is secured to the other end of the conduit and includes a groove in which is mounted a second silicone rubber O-ring 51 which sealingly engages the bore 39. A compression spring 52 is positioned between the annular member 49 and the threaded cap 42 and urges the annular member 49 into engagement with abutment 41. Between the annular end members 47 and 49 extending upstream along the conduit to a point adjacent the exhaust crossover passage are finned elements 53 having longitudinally extending bends. The finned elements form a multipointed star when viewed in transverse cross-section, as shown in FIG. 4 of the drawings. The number of blades or pleats may be increased or decreased to provide the desired heat exchange capacity. The elements are secured at their radially inner vertices to the conduit 46. Each of the longitudinally extending finned elements have stamped louvers opening upstream to divert portions of the hot exhaust gas flow and to maximize heat transfer to the coolant within conduit 46. The heat exchanger is made preferably of stainless steel.

OPERATION

A portion of the engine exhaust gases are received from the engine block into the exhaust crossover passage 28. The exhaust gases traverse the exhaust gas recirculation passage 31 and metered gas passages 33 and are discharged into the reduced pressure area adjacent the carburetor through peripheral openings 34 about the riser bores 17 and 18. As the hot exhaust gases travel through and about the heat exchanger 43 they are cooled prior to passing through the control valve 36. Engine coolant enters the intake manifold from the cooling system of the engine, is conducted through conduit 46 of the heat exchanger and receives heat from the exhaust gases passing thereabout. The coolant exits the intake manifold through outlet 54 and returns to the cooling system of the engine.

Modifications and alterations will occur to those skilled in the art which are included in the scope of the following claims.

We claim:

1. An intake manifold for supplying fuel, air and exhaust gases to a V-type multicylinder internal combustion engine having combustion chambers disposed along opposite sides of a longitudinal centerline, said manifold comprising a casting having an upwardly opening riser passage, a generally horizontal plenum chamber in communication with said riser passage, a set of runner passages extending generally transversely from said plenum chamber, a transversely extending exhaust gas crossover passage, an exhaust gas recirculation passage extending longitudinally from said exhaust gas crossover passage to means for receiving an exhaust gas recirculation control valve constructed to meter the flow of exhaust gas through said exhaust gas recirculation passage, and a metered exhaust gas passage extending from said valve receiving means to said riser passages, a coolant passage to conduct engine coolant through the manifold, a heat exchanger positioned in said exhaust gas recirculation passage comprising a longitudinally extending liquid conduit and finned elements disposed about said conduit, said liquid conduit forming a portion of said coolant passage, seals means separating said conduit from saidi exhaust gas recirculation.

2. An intake manifold for supplying fuel, air and exhaust gases to a V-type multicylinder internal combustion engine having combustion chambers disposed along opposite sides of a longitudinal centerline, said manifold comprising a casting having an upwardly opening riser passage, a generally horizontal plenum chamber in communication with said riser passage, a set of runner passages extending generally transversely from said plenum chamber, a transversely extending exhaust gas crossover passage, an exhaust gas recirculation passage extending longitudinally from said exhaust gas crossover passage to means for receiving an exhaust gas recirculation control valve constructed to meter the flow of exhaust gas through said exhaust gas recirculation passage, a metered exhaust gas passage extending from said valve receiving means to said riser passages, a heat exchanger positioned in said exhaust gas recirculation passage comprising a longitudinally extending liquid conduit and finned elements disposed about said conduit, a first engine coolang passage opening into said exhaust gas recirculation passage, one end of said conduit extending into said engine coolant passage, a second engine coolant passage opening into said exhaust gas recirculation passage at a point spaced from the opening of said first coolant passage and leading to an outlet, the other end of said conduit extending into said second coolant passage, seal means separating said coolant passages and said coolant conduit from said exhaust gas recirculation passage.

3. An intake manifold according to claim 2, a portion of said exhaust gas recirculation passage being centrally disposed and extending beneath said plenum chamber.

4. An intake manifold according to claim 3, abutment means separating an end of said exhaust gas recirculation passage from an end of one of said coolant passages, said seal means including a member extending radially outwardly from one end of said conduit and axially engaging said shoulder, spring means engaging said member and resiliently urging said member against said shoulder.

5. An intake manifold according to claim 2, said finned elements having a plurality of longitudinally extending bends, louvers formed in said finned elements between said bends.

6. An intake manifold according to claim 2, said first coolant passage including a first bore adjacent its junction with said exhaust gas recirculation passage, said second coolant passage comprising a second bore adjacent its junction with said exhaust gas recirculation passage, said first bore and said second bore being coaxial, said seal means comprising a first annular member secured to one end of said conduit, a groove formed in the outer circumference of said first annular member and a heat resistant O-ring positioned in said groove sealingly engaging said first bore, and a second annular member secured to the other end of said conduit, a groove formed in the outer circumference of said second annular member, and a second heat resistant O-ring positioned in said just-mentioned groove sealingly engaging said second bore.

7. An intake manifold according to claim 6, abutment means formed between said exhaust gas recirculation passage and one of said bores, spring means engaging one of said annular members urging said just-mentioned annular member into engagement with said abutment means to position said heat exchanger assembly within said exhaust gas recirculation passage.

8. An intake manifold for supplying fuel, air and exhaust gases to a V-type multicylinder internal combustion engine having combustion chambers disposed along opposite sides of a longitudinal centerline, said manifold comprising a casting having a pair of generally vertical riser passages transversely spaced on opposite sides of said centerline, an upper generally horizontal plenum chamber extending longitudinally from the bottom of one of said riser passages, a lower generally horizontal plenum chamber extending longitudinally from the bottom of the other of said riser passages, a first set of runner passages extending generally transversely from the ends of said lower plenum chamber, a second set of runner passages extending generally transversely from the ends of said upper plenum chamber, portions of said second set of runner passage being positioned over portions of said first set of runner passages, an exhaust gas crossover passage extending transversely under said upper and lower plenum chambers beneath said riser passages, an exhaust gas recirculation passage extending longitudinally from said exhaust gas crossover passage to means for receiving an exhaust gas recirculation control valve constructed to meter the flow of exhaust gas through said exhaust gas recirculation passage, and a metered exhaust gas passage extending from said valve receiving means to said riser passages, a coolant passage to conduct engine coolant through the manifold, a heat exchanger positioned in said exhaust gas recirculation passage comprising a longitudinally extending liquid conduit and finned elements disposed about said conduit, said liquid conduit forming a portion of said coolant passage, seals means separating said conduit from said exhaust gas recirculation passage.

9. An intake manifold for supplying fuel, air and exhaust gases to a V-type multicylinder internal combustion engine having combustion chambers disposed along opposite sides of a longitudinal centerline, said manifold comprising a casting having a pair of generally vertical riser passages transversely spaced on opposite sides of said centerline, an upper generally horizontal plenum chamber extending longitudinally from the bottom of one of said riser passages, a lower generally horizontal plenum chamber extending longitudinally from the bottom of the other of said riser passages, a first set of runner passages extending generally transversely from the ends of said lower plenum chamber, a second set of runner passages extending generally transversely from the ends of said upper plenum chamber, portions of said second set of runner passages being positioned over portions of said first set of runner passages, an exhaust gas crossover passage extending transversely under said upper and lower plenum chambers beneath said riser passages, an exhaust gas recirculation passage extending longitudinally from said exhaust gas crossover passage to means for receiving an exhaust gas recirculation control valve constructed to meter the flow of exhaust gas through said exhaust gas recirculation passage, a metered exhaust gas passage extending from said valve receiving means to said riser passages, a heat exchanger positioned in said exhaust gas recirculation passage comprising a longitudinally extending liquid conduit and finned elements disposed about said conduit, a first engine coolant passage opening into said exhaust gas recirculation passage, one end of said conduit extending into said engine coolant passage, a second engine coolant passage opening into said exhaust gas recirculation passage at a point spaced from the opening of said first coolant passage and leading to an outlet, the other of said conduit extending into said second coolant passage, seal means separating said coolant passages and said coolant conduit from said exhaust gas recirculation passage.

10. An intake manifold according to claim 9, a portion of said exhaust gas recirculation passage being centrally disposed and extending beneath said upper and lower plenum chambers.

11. An intake manifold according to claim 10, abutment means separating an end of said exhaust gas recirculating passage from an end of one of said coolant passages, said seal means including a member extending radially outwardly from one end of said conduit and axially engaging said shoulder, spring means engaging said member and resiliently urging said member against said shoulder.

12. An intake manifold according to claim 9, said finned elements having a plurality of longitudinally extending bends, louvers formed in said finned elements between said bends.

13. An intake manifold according to claim 12, said finned elements having a star-shaped transverse cross section.

14. An intake manifold according to claim 9, said first coolant passage including a first bore adjacent its junction with said exhaust gas recirculation passage, said second coolant passage comprising a second bore adjacent its junction with said exhaust gas recirculation passage, said first bore and said second bore being coaxial, said seal means comprising a first annular member secured to one end of said conduit, a groove formed in the outer circumference of said first annular member and a heat resistant O-ring positioned in said groove sealingly engaging said first bore, and a second annular member secured to the other end of said conduit, a groove formed in the outer circumference of said second annular member, and a second heat resistant O-ring positioned in said just-mentioned groove sealingly engaging said second bore.

15. An intake manifold according to claim 14, abutment means formed between said exhaust gas recirculation passage and one of said bores, spring means engaging one of said annular members urging said just-mentioned annular member into engagement with said abutment means to position said heat exchanger assembly within said exhaust gas recirculation passage.

16. An intake manifold according to claim 15, plug means threadedly engaging said bore adjacent said abutment means, said spring means comprising a compression spring acting between said plug and one of said annular members.

* * * * *